US006609259B2

(12) United States Patent
Cantrell

(10) Patent No.: US 6,609,259 B2
(45) Date of Patent: Aug. 26, 2003

(54) DRAIN ASSEMBLY AND SINK

(75) Inventor: John W. Cantrell, Leawood, KS (US)

(73) Assignee: Metcraft, Inc., Grandview, MO (US)

( * ) Notice: Subject to any disclaimer, the term of this patent is extended or adjusted under 35 U.S.C. 154(b) by 0 days.

(21) Appl. No.: 09/932,477

(22) Filed: Aug. 17, 2001

(65) Prior Publication Data

US 2003/0033670 A1 Feb. 20, 2003

(51) Int. Cl.[7] ..... E03C 1/23
(52) U.S. Cl. ..... 4/688; 4/640; 4/650; 4/683
(58) Field of Search ..... 4/640, 650, 653, 4/679–685, 688–693, 291

(56) References Cited

U.S. PATENT DOCUMENTS

| | | | | | |
|---|---|---|---|---|---|
| 758,040 | A | | 4/1904 | Angell | |
| 760,342 | A | | 5/1904 | Metosh | |
| 789,736 | A | | 5/1905 | Hoey | |
| 965,164 | A | | 7/1910 | Dunbar | |
| 978,913 | A | | 12/1910 | Madden | |
| 1,018,021 | A | | 2/1912 | Willetts | |
| 1,204,033 | A | | 11/1916 | Kelly | |
| 1,408,402 | A | | 2/1922 | Rogers | |
| 1,665,029 | A | | 4/1928 | Hartnett | |
| 1,807,900 | A | | 6/1931 | Dougherty | |
| 1,839,663 | A | * | 1/1932 | Fehn | 4/683 |
| 1,857,054 | A | | 5/1932 | Luppes | |
| 1,931,632 | A | * | 10/1933 | Stoddard | 4/683 |
| 2,739,317 | A | | 3/1956 | Abresch | |
| 2,767,407 | A | | 10/1956 | Weiss | |
| 3,393,409 | A | | 7/1968 | Politz | |
| 3,495,280 | A | | 2/1970 | Galbiati | |
| 3,583,003 | A | | 6/1971 | Thompson | |
| 3,860,978 | A | | 1/1975 | Wirth | |
| 3,908,208 | A | | 9/1975 | McIlroy | |
| 4,173,800 | A | | 11/1979 | Flegel et al. | |
| 4,218,786 | A | | 8/1980 | Taglarino | |
| 4,301,554 | A | | 11/1981 | Wojcicki | |
| 4,369,532 | A | | 1/1983 | Houchins et al. | |
| 4,403,355 | A | | 9/1983 | Petty | |
| 4,516,278 | A | | 5/1985 | Lamond | |
| 4,555,820 | A | * | 12/1985 | Dragstrem | 4/679 |
| 4,773,436 | A | | 9/1988 | Cantrell et al. | |
| 4,811,431 | A | | 3/1989 | Kraverath | |
| 4,882,789 | A | | 11/1989 | Kraverath | |
| 4,945,579 | A | * | 8/1990 | Husting | 4/688 |
| 4,967,425 | A | | 11/1990 | Kawamura et al. | |
| 5,341,523 | A | * | 8/1994 | Barnes | 4/689 |
| 5,419,359 | A | | 5/1995 | Kor | |
| 5,715,550 | A | | 2/1998 | Griffin | |
| 5,873,136 | A | * | 2/1999 | Geeham | 4/684 |
| 6,058,526 | A | | 5/2000 | Parisi et al. | |
| 6,145,136 | A | | 11/2000 | Parisi et al. | |
| 6,192,531 | B1 | | 2/2001 | Fritz et al. | |

* cited by examiner

*Primary Examiner*—Tuan N. Nguyen
(74) *Attorney, Agent, or Firm*—Spencer Fane Britt & Browne LLP

(57) ABSTRACT

A drain assembly is provided that eliminates the need for reconfiguring of existing plumbing during installation of a deep-sink assembly while maintaining a suitable working height. The drain assembly including a hollow body, a valve within the body and a mount to operably connect the valve within the hollow body. The hollow body includes an inlet, an outlet, and an inner wall positioned between the inlet and the outlet. A fluid path enters the inlet of the body in a first direction and is diverted to a second direction substantially perpendicular to the first direction by the inner wall. The diverted fluid path exits the body moving in the second direction. The mount is located at least partially within the outlet.

8 Claims, 3 Drawing Sheets

DRAIN ASSEMBLY AND SINK

FIELD OF THE INVENTION

The present invention relates to an improved drain assembly for a sink and a replacement deep-sink assembly utilizing the improved drain assembly.

BACKGROUND OF THE INVENTION

Commercial establishments, such as restaurants, and institutions typically have sinks of large capacity to be able to wash dishes, pots, pans, and like items or to rinse such items of left-over materials prior to washing these items in automatic dishwashers. Because of the large capacities of these sinks and the chemicals employed in the washing or rinsing operation, the use of a simple stopper or stainer to plug up the drain opening of such sinks to fill the sinks with water are generally not used. Instead, these sinks have had manually operated valves installed in the drain lines from the sinks to open and close the drain lines. Typically, the valves have been provided as part of a drain assembly. For example, these valves have been of a stopper-type which employ a plunger having a head for sealing off a drain opening and a stem which depends through the opening into the drain line. In addition, these types of valves employ a lever system for moving the plunger up and down to open and close the drain assembly. Typically, these lever systems have a handle which can be manually operated by the user. In alternative constructions, the plunger may be actuated by a twisting motion utilizing a cam. Other valves have also been known which employ closure bodies with a through opening of rectangular or cylindrical shape so as to conduct a flow therethrough when in an open position. For example, U.S. Pat. No. 6,058,526, issued to Parisi et al., hereby incorporated by reference, discloses a drain assembly having a closure body with a cylindrical through opening. Various types of manual controls and handles have been provided for rotating the closure member between the open and closed positions when desired.

The drain assemblies of the prior art that utilize manually operated valves installed within the drain assembly are usually designed to have a single, vertical fluid path through the drain assembly. In other words, the prior art drain assemblies each have an inlet located at a hole in the bottom of the sink basin, and an outlet located several inches directly below the inlet. The valve and a means for operating the valve is located between the inlet and the outlet. If it is desired to alter the fluid path, for example to connect the drain to plumbing located in a wall behind the sink, an appropriately angled pipe fitting must be attached to the outlet of the drain assembly.

FIG. 1 shows a prior art drain assembly that has a single, vertical fluid path traveling through the drain assembly. Drain assembly 210 includes inlet 220 located at the top of the drain, and outlet 230 located at the bottom of the drain directly below inlet 220. The direction of the fluid path traveling through drain 210 is unaltered between inlet 220 and outlet 230. A valve is located within drain 210 to regulate the flow of fluid along the fluid path. Handle 240 is attached to the valve for easy opening and closing of the valve by an operator. Drain 210 includes an overflow inlet located on the side of the drain. Overflow inlet 225 is positioned to allow fluid traveling from an overflow drain located in the sink to bypass the valve of drain 210 and thus prevent overfilling and overflowing of the sink.

FIG. 3 shows inlet 220 of drain 210 attached to sink 250. The inlet of elbow 235 is attached to outlet 230 of drain 210.

Elbow 235 comprises a pipe having a ninety degree bend to alter the direction of the fluid path exiting drain 210 from a vertical direction to a horizontal direction. The outlet of elbow 235 can be attached to a sewer pipe that connects to a sewer line. The sewer pipe ordinarily runs into the wall directly behind the sink. The height of this pipe is usually determined by the depth of the sink that is to be installed. It is preferable to maintain a sink working height C between thirty and thirty-four inches. Thus, the deeper the sink basin, the lower the sink-base height. Sewer pipe height A will generally be sink-base height B less the height of drain 210 and elbow 235.

Many restaurants and commercial kitchens are constructed to include a large capacity rinsing sink having a basin depth D of twelve to fourteen inches. To maintain a working height C of thirty-four inches for a sink having basin depth D of fourteen inches, results in a sink-base height B of twenty inches. Utilizing prior art drain 210 and elbow 235 with this assembly results in a sewer pipe height A of thirteen inches.

A common problem with the use of the combination of prior art drain 210 and elbow 235 results when a standard large capacity rinsing sink (i.e. basin depth D of fourteen inches) is to be replaced by an extra-large capacity sink for a pot and pan washing machine, such as the machine disclosed in this inventor's U.S. Pat. No. 4,773,436, which is incorporated by reference herein. An extra-large capacity sink usually has a basin depth D of eighteen to nineteen inches. To maintain a working height C of thirty-four inches for a sink having basin depth D of eighteen inches, requires a sewer pipe height A of nine inches. If the original sink had a sewer pipe height A of thirteen inches, a significant amount of plumbing work is required to reconfigure the sewer line. This plumbing work often includes tearing out a portion of the wall behind the sink, reconfiguring the existing plumbing located behind the wall, and rebuilding the wall. The cost associated with reconfiguring existing plumbing usually ranges between $200 to $300 per installation. Thus, a significant cost savings could be achieved if the need to reconfigure the existing plumbing was eliminated.

In addition to the costs associated with reconfiguring existing plumbing, the use of the prior art drain and elbow combination with an extra-large capacity sink includes the disadvantage of reducing the amount of usable space located below the sink. Most commercial kitchen sinks require grease traps to catch the grease that is washed off of the pots and pans. Most standard grease traps are ten inches or more in height. As discussed above, to maintain a suitable working height C for sink 250, sewer pipe height A will be approximately nine inches. A standard grease trap will not be able to fit below such a sink configuration. Thus the grease trap must either be located in another location, wasting usable space, or a special low profile grease trap must be used. Low profile grease traps have a larger footprint than standard grease traps, and therefore have a lower height; however, low profile grease traps cost approximately twenty percent more than standard grease traps.

It is desirable to design an extra-large capacity sink and drain arrangement that can be used to replace an existing sink and drain configuration without requiring expensive reconfiguration of the existing plumbing. It is also desirable to design a drain that can be used in combination with a sink having a relatively deep basin to provide a maximum amount of usable space below the sink.

SUMMARY OF THE INVENTION

A principal object of the instant invention is to provide a drain-valve assembly for use in combination with a deep sink assembly that can provide a maximum amount of usable space below the sink. It is also an object of the instant invention to provide a drain-valve assembly that will eliminate the need for costly reconfiguring of existing plumbing when an existing sink is replaced with a deeper sink.

The above described objectives are achieved through the use of a drain assembly including a one piece hollow body, a valve within the body, and a mount to operably connect the valve to the body. The body includes an inlet, an outlet, and an inner wall positioned between the inlet and the outlet. A fluid path enters the inlet of the body in a first direction and is diverted to a second direction substantially perpendicular to the first direction by the inner wall. The fluid path then exits the outlet of the body in the second direction. The mount is located at least partially within the outlet.

The present invention diverts the fluid path within the drain assembly, thus eliminating the need for the separate elbow attachment located at the outlet of the prior art drains. The elimination of the elbow minimizes the difference between the height of the sewer pipe and the height of the sink-base. The use of the instant invention allows for the easy replacement of an existing sink with a new, deeper basin sink, without requiring reconfiguration of the existing plumbing. This results in a substantial cost and time savings to the installer.

The instant invention also increases the required sewer pipe height for deep basin sinks while maintaining a suitable working height for the sink. By increasing the sewer pipe height, the amount of usable space directly below the sink is maximized. The space directly below the sink can be used to store a grease trap, which is commonly used on most commercial sink assemblies.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF THE PREFERRED EMBODIMENT

Preferred embodiments of the present invention are hereinafter described with reference to the accompanying drawings.

Figures 1, 2:
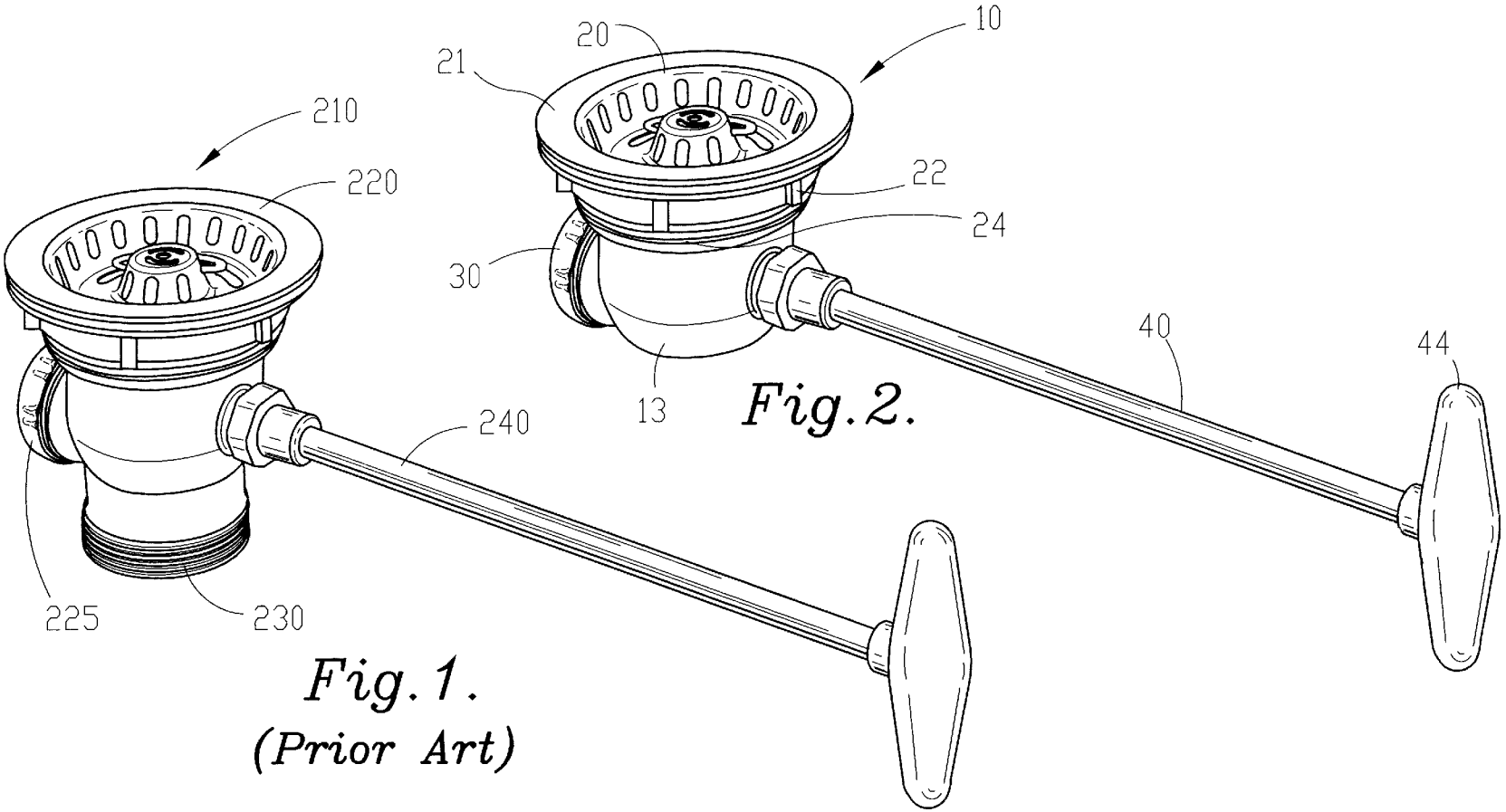
Fig. 1. (Prior Art)
FIG. 1 is a perspective view of a prior art drain assembly.
FIG. 2 is a perspective view of the drain assembly of the instant invention.

Referring to FIG. 2, a perspective view of the drain assembly of the instant invention is provided. FIG. 2, shows drain 10 which comprises a hollow body. Hollow body 13 includes inlet 20, and drain outlet 30. Inlet 20 is located at the top of body 13, and outlet 30 is located at the back side of drain body 13.

Inlet 20 includes annular flange 21, and flange nut 22 threaded to threads 24 of body 13. As is shown in the partial cut-away of FIG. 7, drain 10 is placed through an opening in the bottom of sink 50. Flange 21 seats about the opening on the inside of the basin of sink 50 and body 13 extends outside of the basin. Flange nut 22 is threaded onto body 13 from the outside of the basin. Flange nut 22 is tightened against the opening in sink 50 to secure drain 10 into position.

In an alternative embodiment, inlet 20 includes an internal thread and flange 21 seats about an opening outside the basin of sink 50. A second annular flange seats about an opening inside the basin of sink 50. The second flange includes an external thread that passes through the ink opening to engage the internal threads of inlet 20 and secure drain 10 to sink 50.

Figures 3, 4, 5, 6:
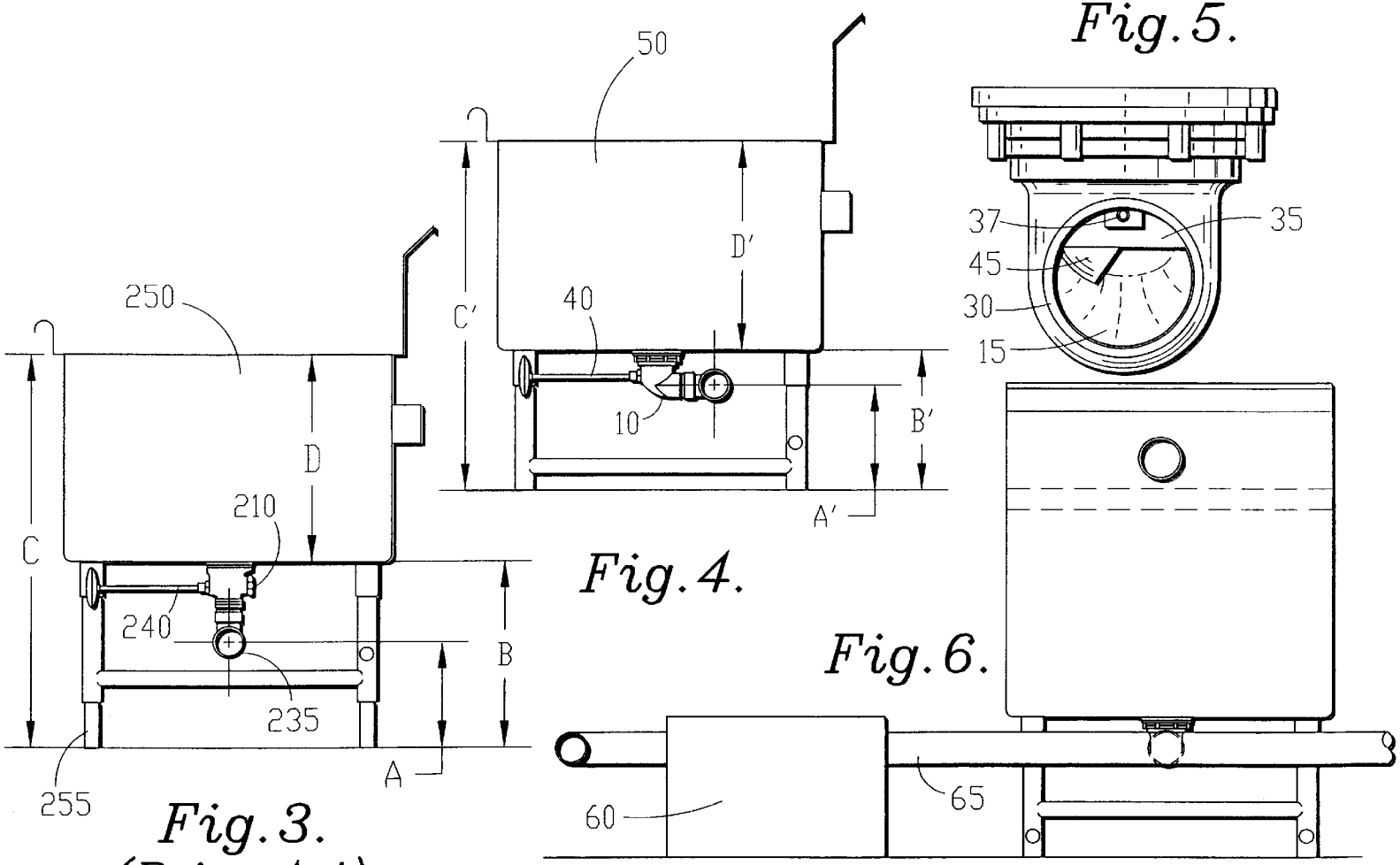
Fig. 3. (Prior Art)
FIG. 3 is a side elevation view of the prior art drain assembly of FIG. 1 incorporated into a sink assembly.
FIG. 4 is a side elevation view of the drain assembly of FIG. 2 incorporated into a sink assembly.
FIG. 5 is a rear elevation view of the drain assembly of FIG. 2.
FIG. 6 is a rear elevation view of a sink assembly of the instant invention.

FIG. 5 is a rear view of drain 10 showing outlet 30. Support member (or mount) 35 is partially located within outlet 30. Mount 35 is attached to the interior of hollow body 13. Valve 45 is attached to mount 35 at rotatable connection 37.

The rotatable valve of the preferred embodiment is described in detail in U.S. Pat. No. 6,058,526, incorporated herein by reference. Valve 45 is a hollow ball valve including an operating means that is rotated between a closed and an open position using handle 40 to control to flow of fluid through hollow body 13. Valve 45 has a spherically shaped body with a tubular bore disposed axially of inlet 20 when in an open position, while being disposed transversely of inlet 20 when in a closed position. Valve 45 includes a socket on one side to accept handle 40, and a pin on the opposite side of the socket to fit into an aperture of mount 35 and form rotatable connection 37.

Figure 7:
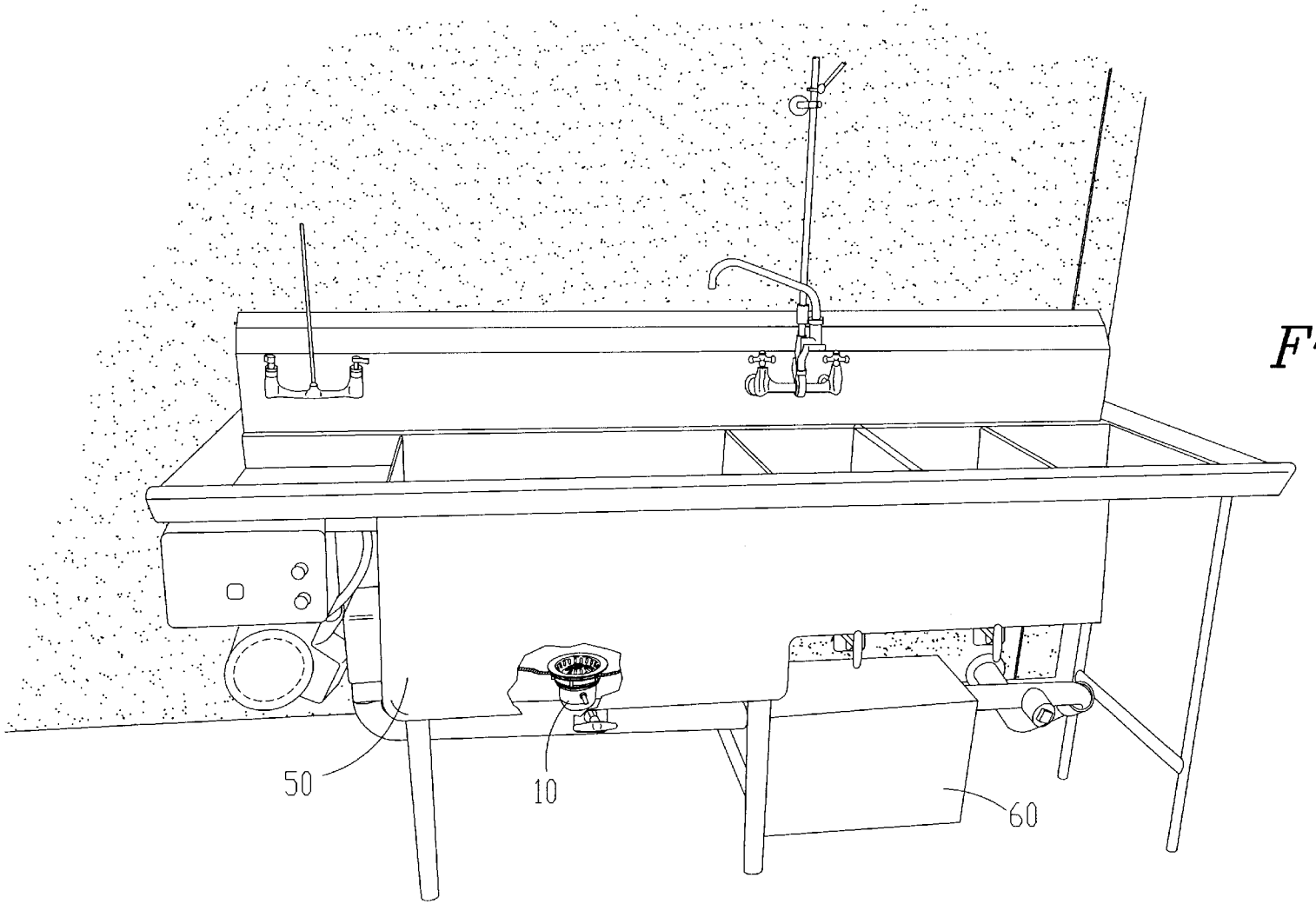
FIG. 7 is a front elevation view of the sink assembly of FIG. 6, showing a drain assembly in partial cut-out.

The means for operating valve 45 can include a valve operating handle 40. The operating handle is located on the front side of drain body 13 directly opposite of outlet 30. Valve operating handle 40 extends into body 13 through a threaded aperture to connect with hollow ball valve 45. Handle 40 is rotatably connected to body 13 using handle nut 42 that engages with the threads of the aperture. Handle 40 extends out away from body 13, and includes grip 44 for easy rotation by an operator. FIG. 7 shows handle 40 extending out towards the front side of sink 50.

An alternative embodiment includes a stopper-type valve instead of the ball valve of the instant invention. In such an embodiment, valve 45 comprises a cylindrical head positioned transversely to inlet 20. Valve 45 includes a stem protruding transversely from the cylindrical head into body 13 of drain 10. The stem connects to a cam that is rotated by handle 40. As the cam is rotated, the cylindrical head of valve 45 travels up and down in a direction axial to inlet 20. When the cylindrical head is in a down position it seals inlet 20 to prevent the flow of fluid through the drain. When the head is up fluid is permitted to flow through the drain. The side of the cam opposite the handle, includes a pin that is rotatably connected to mount 35 to form a rotatable connection. The stem can be positioned to slide within axial channels located on the interior of body 13 to provide smooth linear movement of the head.

FIG. 5 shows inner wall 15 of hollow body 13. In the preferred embodiment, inner wall 15 is gradually curved between inlet and outlet to prevent accumulation of fluid or debris, while diverting the path of fluid traveling through drain 10. In operation, valve 45 is rotated into an open position, fluid enters hollow body 13 at inlet 20 in a first direction that is substantially vertical. The fluid then contacts inner wall 15 and the fluid path is diverted to a second direction that is substantially perpendicular to the first direction. The fluid then exits body 13 traveling in the second direction through outlet 30.

FIG. 6 shows a rear view of a deep basin sink assembly of the instant invention that can be used as a replacement for an existing sink assembly. Drain 10 is connected to the bottom side of deep-sink 50. Outlet 30 of drain 10 is connected to sewer pipe 65 of the existing plumbing. The existing plumbing can include a grease trap. Because of the space savings obtained through the use of the instant invention, grease trap 60 can be positioned below sink 50, as is shown in FIG. 7.

The principal benefit of the instant invention is easily identified by a comparison of the deep-sink assembly of FIG. 4 with the prior art sink assembly of FIG. 3. An example will now be discussed wherein sewer pipe height A of the prior art sink assembly is thirteen inches, and sewer pipe height A' of the instant invention deep-sink assembly is also thirteen inches. Additionally, basin depth D of the prior art assembly is eighteen inches, and basin depth D' of the inventive deep-sink assembly is also eighteen inches. In this example, prior art drain assembly will result in a working height C of thirty-eight inches, and a sink-base height B of twenty inches. The prior art requires the use of leg extensions 255 to raise the sink to the proper height. Alternatively, the inventive deep-sink assembly will result in a working height C' of thirty-four inches, a sink-base height B' of sixteen inches, and does not require the use of any leg extensions. As discussed above in the Background of the Invention section, an ideal working height ranges between thirty and thirty-four inches. Anything greater than thirty-four inches will often require the operator of the sink to use a step stool, or some other booster, to properly operate the sink. Such is inconvenient for the sink operator, and now unnecessary due to the instant invention.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive drain assembly is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

Having thus described the invention what is claimed as new and desired to be secured by Letters Patent is as follows:

1. A drain assembly for a sink comprising:

a one piece hollow body defining a fluid path, said body including:

an inlet for receiving a fluid traveling along said fluid path, said inlet including an annular flange to seat about an opening in the sink;

an outlet for discharging the fluid traveling along said fluid path; and an inner wall positioned between said inlet and said outlet, said inner wall diverting aid fluid path from a first direction to a second direction substantial perpendicular to said first direction;

a valve in association with said inlet for selectively opening and closing said fluid path; and a mount attached to said body and located at least partially within said outlet, said mount operably connecting said valve to said body such that said mount and valve are positioned at least partially within said diverted fluid path.

2. The drain assembly as claimed in claim 1 further comprising a connection to attach said body to the sink.

3. The drain assembly as claimed in claim 2 wherein said inlet of said body further comprises an external thread for passage through an opening in the sink, and said connection comprises a flange nut threaded onto said external thread of said body to secure said body to the sink.

4. The drain assembly as claimed in claim 2 wherein said connection comprises a sealer.

5. A drain assembly for a sink comprising:

a one-piece hollow body defining a fluid path, said body having an external thread for passage through opening in the sink and an annular flange to seat about an opening in the sink;

a hollow ball valve rotatably mounted in said body in said fluid path, said ball valve being rotatable between closed position closing said fluid path and an open position opening said fluid path;

means for rotating said ball valve between said positions;

a flange nut threaded onto said external thread of said body to secure said body in the sink;

an inner wall within said hollow body for diverting said fluid path in a direction substantially perpendicular to a first direction of said fluid path; and a support-member for mounting said ball valve in said body, said support-member and ball valve are positioned at least partially within said diverted fluid path.

6. A deep-sink assembly for replacement of an existing sink assembly, the existing sink having a basin depth of approximately twelve to fourteen inches, said deep-sink assembly maintaining a working height equivalent to the working height of the existing sink assembly without a need for reconfiguring of existing plumbing, said deep-sink assembly comprising:

a basin having a depth of approximately eighteen to nineteen inches, said basin having an opening in a bottom thereof;

a drain comprising a one piece hollow body defining a fluid path, said body including:

an inlet for receiving a fluid traveling along said fluid path, said inlet including an annular flange to seat about said opening in said basin;

an outlet for discharging the fluid traveling along said fluid path, said outlet connected an existing plumbing, said existing plumbing being located below said basin; and an inner wall positioned between said inlet and said outlet, said inner wall diverting said fluid path from a first direction to a second direction substantially perpendicular to said first direction, said diverted fluid path being located approximately three inches below said bottom of said basin;

a valve in association with said inlet for selectively opening and closing said fluid path; and a mount attached to said body and located at least partially within said outlet, said mount operably connecting said valve to said body such that said mount and valve are positioned at least partially within said diverted fluid path.

7. The deep-sink assembly as claimed in claim 6 wherein said existing plumbing includes a grease trap.

8. The deep-sink assembly as claimed in claim 7 wherein said grease trap has a height of approximately ten inches.

* * * * *

UNITED STATES PATENT AND TRADEMARK OFFICE

CERTIFICATE OF CORRECTION

PATENT NO. : 6,609,259 B2
DATED : August 26, 2003
INVENTOR(S) : John W. Cantrell It is certified that error appears in the above-identified patent and that said Letters Patent is hereby corrected as shown below:

Column 6,
Line 36, now reads "passage through opening" should read -- passage through an opening --.
Line 40, now reads "rotatable between closed" should read -- rotatable between a closed --.

Signed and Sealed this

Eleventh Day of November, 2003

JAMES E. ROGAN
*Director of the United States Patent and Trademark Office*